US006148571A

United States Patent [19]

Seyller

[11] Patent Number: 6,148,571

[45] Date of Patent: Nov. 21, 2000

[54] ROOFING DEVICE FOR MODULATING AND DISTRIBUTING SUNLIGHT

[76] Inventor: Francois Seyller, 21 rue de l'Yser, 67000 Strasbourg, France

[21] Appl. No.: 09/171,416

[22] PCT Filed: Apr. 14, 1997

[86] PCT No.: PCT/FR97/00652

§ 371 Date: Oct. 19, 1998

§ 102(e) Date: Oct. 19, 1998

[87] PCT Pub. No.: WO97/39208

PCT Pub. Date: Oct. 23, 1997

[30] Foreign Application Priority Data

Apr. 18, 1996 [FR] France ..... 96 05056

[51] Int. Cl.[7] ..... E04B 7/18

[52] U.S. Cl. ..... 52/200; 52/66; 52/173.3; 52/36.2; 52/1; 52/DIG. 17

[58] Field of Search ..... 52/200, 66, 745.06, 52/24, 173.3, 36.2, 1, DIG. 17; 49/38, 39

[56] References Cited

U.S. PATENT DOCUMENTS

| | | | |
|---|---|---|---|
| 2,642,634 | 6/1953 | Recob | 49/38 |
| 4,067,347 | 1/1978 | Lipinski | 126/624 |
| 4,616,451 | 10/1986 | Glick | 52/66 |
| 5,035,091 | 7/1991 | Ebato | 52/1 |
| 5,167,097 | 12/1992 | Robbie et al. | 52/6 |
| 5,167,341 | 12/1992 | Morton et al. | 220/346 |
| 5,650,875 | 7/1997 | Kanada et al. | 359/592 |
| 5,829,204 | 11/1998 | Lonnberg | 52/66 |

FOREIGN PATENT DOCUMENTS

| | | |
|---|---|---|
| 2 337 246 | 7/1977 | France . |
| 44 28 983 | 2/1996 | Germany . |
| 532 600 | 1/1941 | United Kingdom . |
| 536 127 | 5/1941 | United Kingdom . |
| 538 752 | 8/1941 | United Kingdom . |

*Primary Examiner*—Christopher T. Kent
*Assistant Examiner*—Jennifer I. Thissell
*Attorney, Agent, or Firm*—Young & Thompson

[57] ABSTRACT

The invention concerns a device that creates a semishaded surface whose level of exposure to sunlight can be determined and on which the sunlight can be distributed uniformly for a given period. It consists of a fixed framework (1) supporting a mobile reciprocating frame (2). A skylight (A) with slats is set into the mobile frame (2). The mobile frame (2) supports one of several frames (3) into which are set skylights (b) with slats. The adjustable deviation between the frames (2 and 3) determines the level of exposure to sunlight. This device is especially intended for persons who wish to be exposed to a reasonable level of sunlight. Its field of application is particularly, though not exclusively, in the tourism, leisure and accommodation industries.

10 Claims, 5 Drawing Sheets

ROOFING DEVICE FOR MODULATING AND DISTRIBUTING SUNLIGHT

CROSS REFERENCE TO RELATED APPLICATION

This is the 37 USC 371 national stage of international application PCT/FR97/006542 which was filed on Apr. 16, 1997 and designated the United States of America.

BACKGROUND OF THE INVENTION

The present invention relates to a device permitting persons to have a surface for which they can regulate the level of sunlight and distributing this sunlight in a uniform manner over a certain period.

At present, persons can expose themselves either to full sunshine by using protective creams, or they can use a semi-shaded location (a cover, a tree . . . ). The use of protective creams requires frequent renewal of the application above all when the periods of exposure are interspersed with swimming. Certain persons are also allergic to these products or cannot stand direct sunlight. The conventional semi-shaded locations do not offer the possibility of selecting the quantity of sunlight desired and do not distribute it over all the body.

SUMMARY OF THE INVENTION

The device according to the invention permits overcoming these drawbacks. It thus consists in creating a roof from two layers of superposed skylight that can slide relative to each other. The lower layer is constituted of a skylight, the upper layer of one or several skylights. The offset of these skylight layers determines the quantity of sunlight passing through the roof and hence the level of exposure to sunlight. This offset is adjustable. This roof is moved with reciprocating motion, which permits displacing the exposed regions and thereby distributing the exposure to sunlight for the period of this movement. This sweeping of the sun's rays has another advantage in tanning uniformly persons lying motionless below the roof. Moreover, the reciprocating movement of these regions exposed to sunlight mimics the shade which exists under the leaves of a tree when a light breeze blows.

BRIEF DESCRIPTION OF THE DRAWINGS

The accompanying drawings show a possible embodiment of the invention.

DETAILED DESCRIPTION OF THE INVENTION

Figure 1:
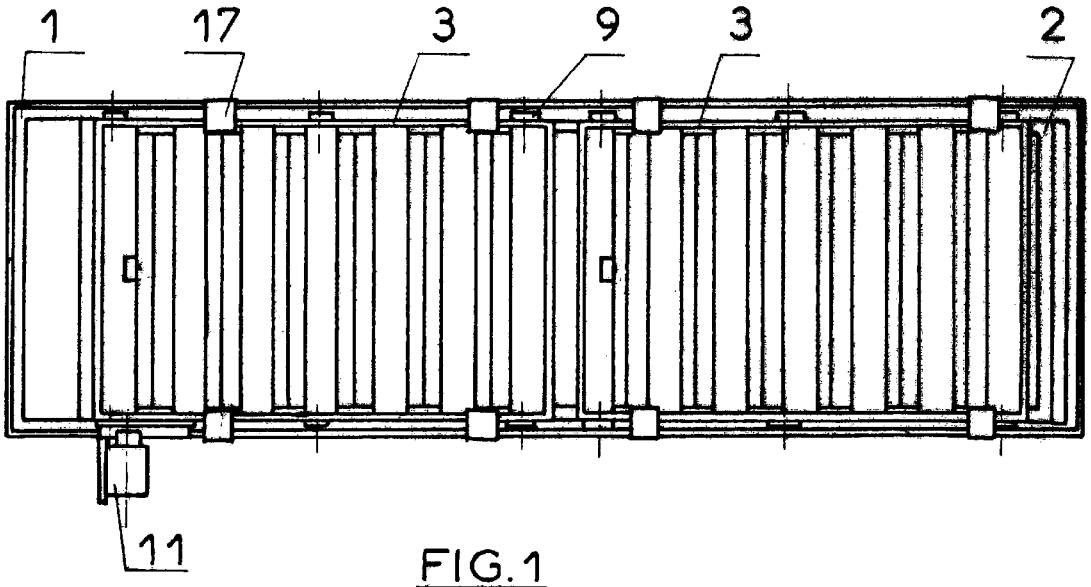
FIG. 1 shows a view from above of a device of the invention.
Figure 2:
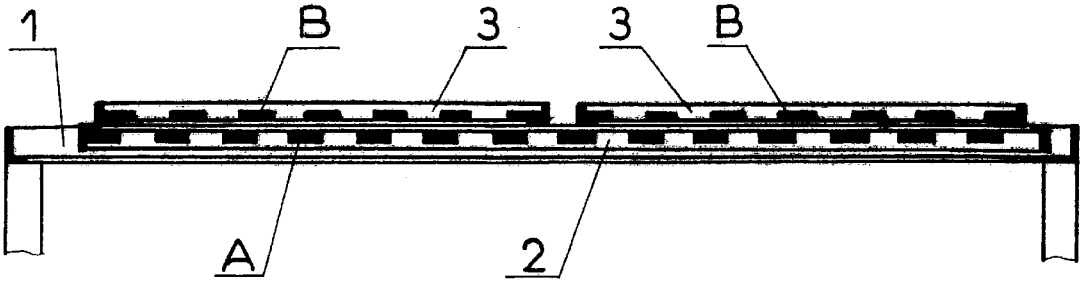
FIG. 2 shows a cross section of the invention.
Figure 3:
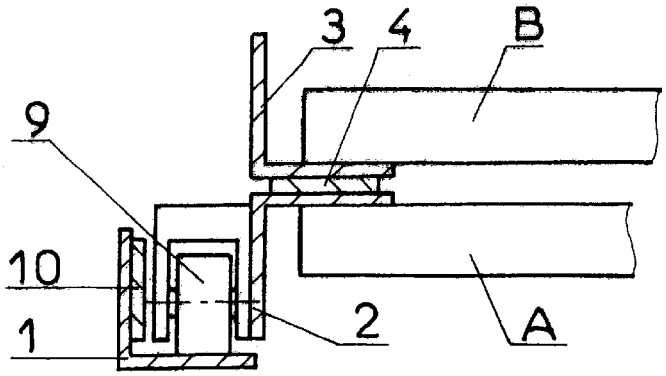
FIG. 3 shows in cross section a possible manner of moving the different frames relative to each other.

With reference to these drawings, the device comprises a fixed framework (1) on which rests a frame (2) supporting a skylight constituted by slats (A). The frame (2) itself supports one or several chassis (3) on which are fixed skylights constituted by slats (B). The position of the frame (3) relative to the chassis (2) is adjustable. This adjustment permits continuous movement, from one position of superposition of the slats (A) and (B) to a completely offset position of these slats, the slats (B) of the skylight of the chassis (3) coming in this case to be disposed above the openings of the skylight of the frame (2). By adjustment, the desired level of exposure to sunlight is determined. Each chassis (3) can have a different and independent adjustment relative to the frame (2). After adjustment, the chassis (3) are fixed on the frame (2). To distribute uniformly sunlight on the ground, the frame (2) receives a reciprocating movement relative to the framework (1). The framework (1) rests on supports which can be quite various (metallic or wooden structure, masonry element, . . . ), the assembly of the device thus forming a roof.

Figure 4:
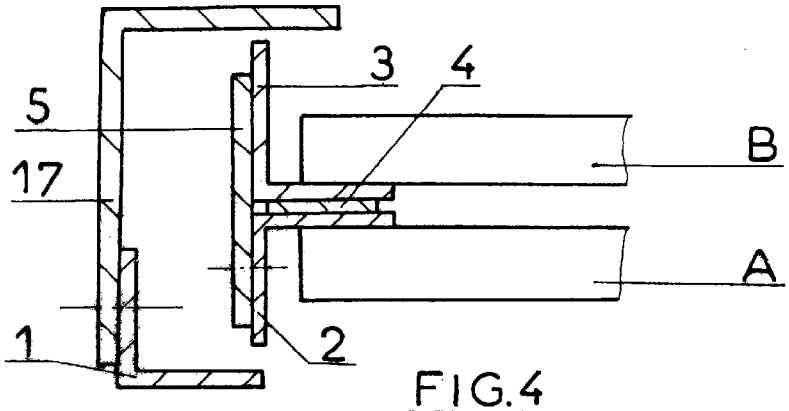
FIG. 4 shows a possible solution to avoid raising of the device in case of a gust of wind.
Figure 8:
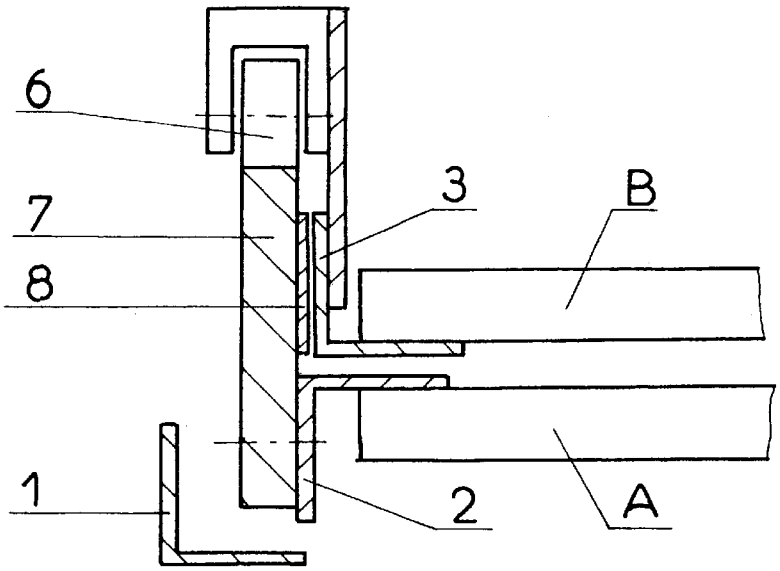
FIG. 8 shows a modification to carry out movement between the two layers of skylight.

To effect movement of the chassis (3) relative to the frame (2), there can be used any device permitting carrying out this function. FIG. 4 gives a possible arrangement. An anti-friction material (4) is disposed between the chassis (3) and (2) and the frame lateral guides (5) maintain the frame (3) in place. FIG. 8 gives another possibility to carry out this function. The chassis (2) receives rollerways (7) and the chassis (3) receives rollers (6). Anti-friction strips (8) are disposed on the lateral internal surfaces of the rollerway (7) to ensure better movement of the chassis (3).

Figure 5:
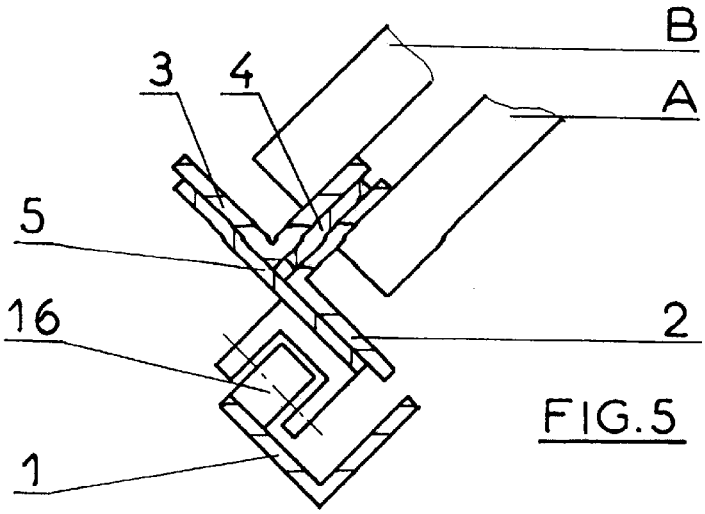
FIG. 5 shows one manner of permitting inclining the device of the invention.
Figure 6:
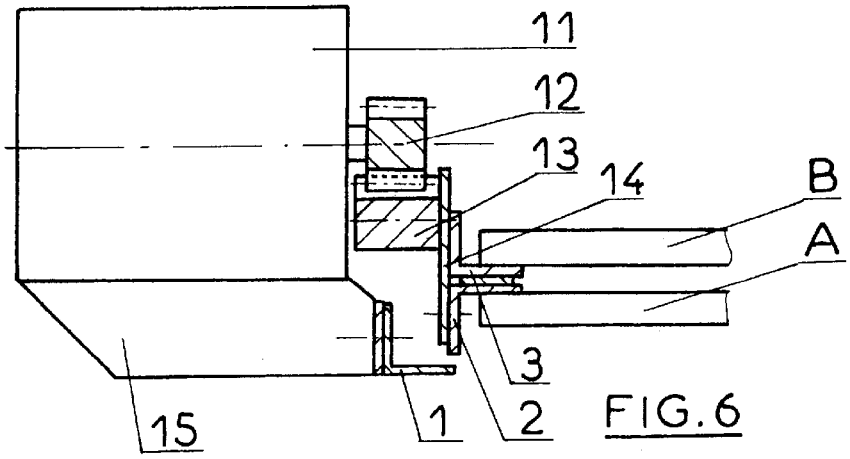
FIG. 6 shows one manner of effecting the reciprocating movement.

For the reciprocating movement of the assembly of frame (2) and chassis (3), there can be fixed rollers (9) on the frame (2). These rollers roll on the framework (1). An anti-friction element (10) can guide laterally the frame (2). A wear member (not shown in the drawing) can be interposed between the roller (9) and the framework (1). The reciprocating movement is effected by means of a motor (11) or a motor reducer. The ends of movement or an electronic control of the motor in the case for example of a step-by-step motor ensure reversal of the direction of rotation of the motor. A pinion (12) drives a rack (13) fixed to the frame (2) by means of the piece (14). The motor is fixed to the framework (1) by the aid of the support (15). FIG. 5 shows a possible device to permit inclination of the device of the invention. In this case, a roller (16) fixed to the frame (2) bears on the internal lower surface of the framework (1). Here again, a wear member (not shown) can be interposed between the roller (16) and the framework (1).

Angle members (17) fixed from place to place on the framework (1) prevent the rising of the frame (2) and chassis (3).

Figure 7:
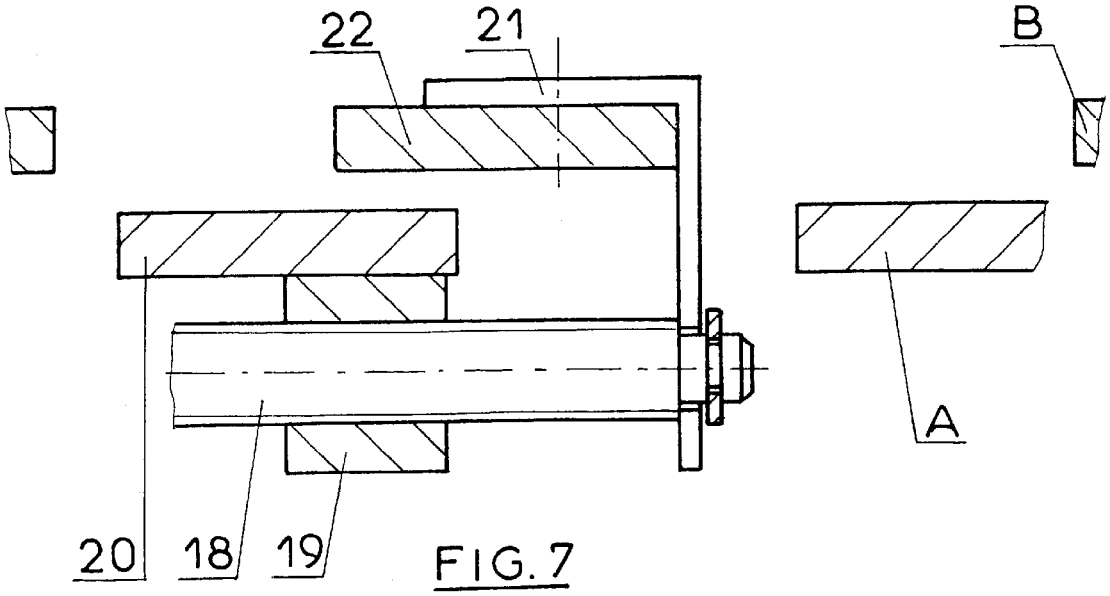
FIG. 7 shows a possible way of adjusting the spacing of the skylights.

FIG. 7 shows a possible embodiment of a device for adjustment of the frame (3) relative to the chassis (2). A screw-threaded rod (18) passes through a tapped member (19). This latter is rendered solid with a cross piece (20) fixed on the frame (2). The screw-threaded rod is actuated with a handle and angle return not shown on the drawing. The end of the screw-threaded rod (18) passes through an angle element (21) secured to a cross member (22) fixed on the chassis (3). Graduations marked below the cross member (22) permit knowing the selected level of exposure to sunlight. As a modification, and according to their resistance, the slats (A) and (B) of the skylights can be used in lieu and in place of the cross members (20) and cross pieces (22).

Figure 9:
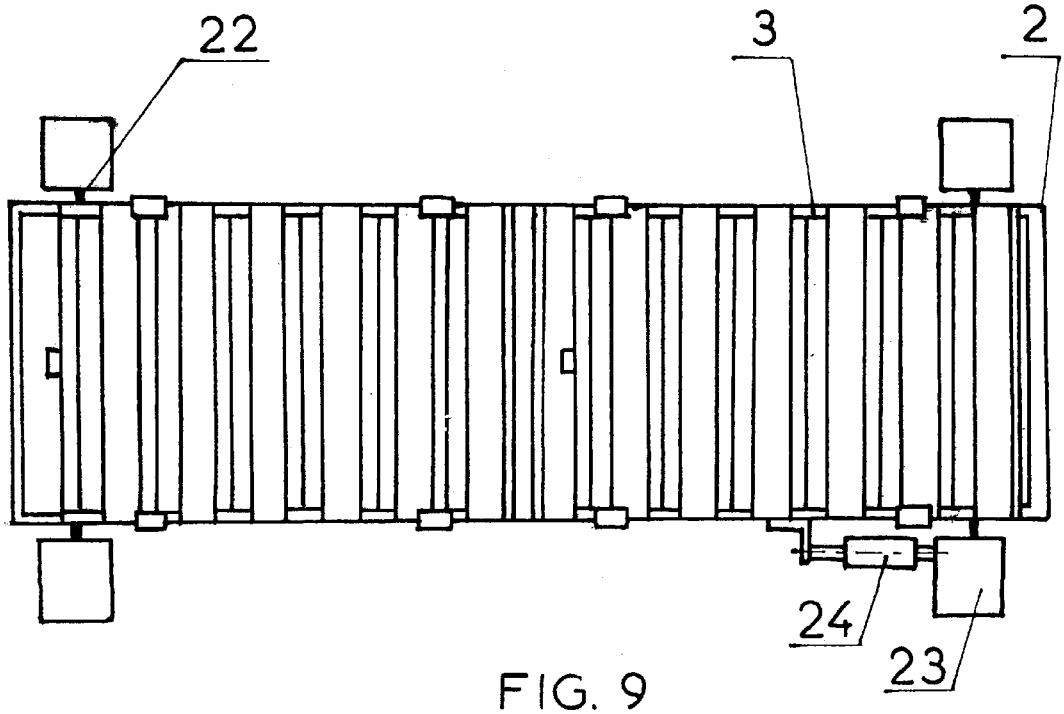
FIG. 9 shows a view from above of another device of the imvention.
Figure 10:
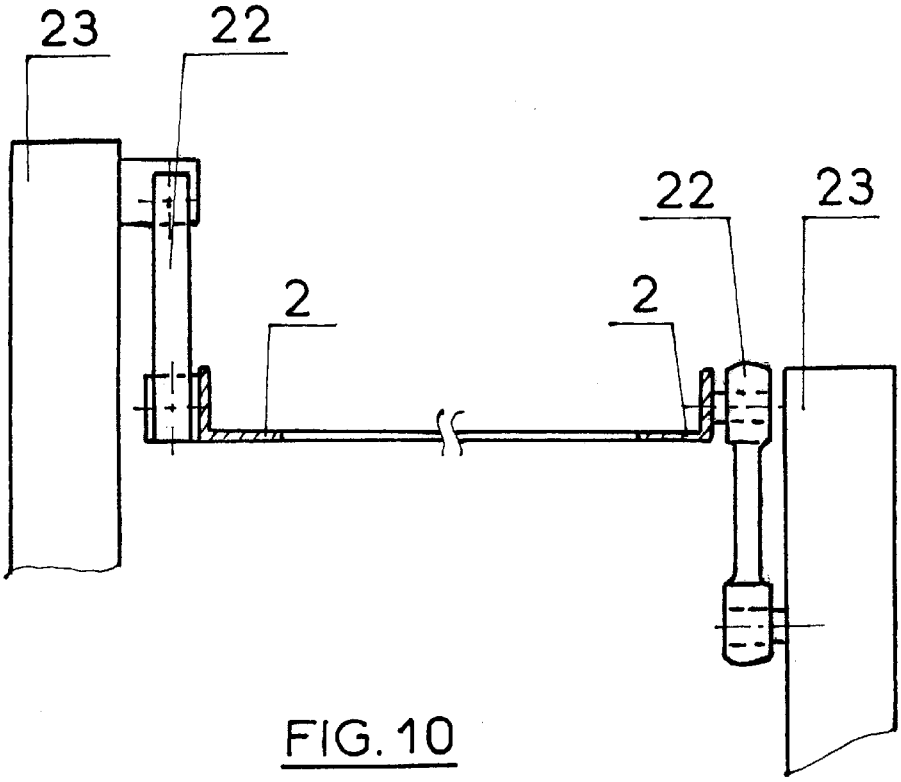
FIG. 10 shows in cross section this other device.

FIG. 9 shows a modification of the invention which permits omitting the framework (1). The frame (2) is connected to the structure (23) serving as a support for the roof by means of connection elements (22). The structure (23) can be various and changed as for example as posts or a wall. Similarly, the connection elements can be constituted by cables, rods, slats or any other system permitting the movement of the frame (2) relative to the structure (23). The connection elements (22) can either serve to suspend the roof, or to support it. The left portion of FIG. 10 shows an arrangement permitting suspending the roof; in this case, the connection element (22) is a slat flexible in the direction of movement, rigid in the direction perpendicular to movement. The right portion of FIG. 10 shows an arrangement permitting supporting the roof; in this case, the connection element is a rod. The reciprocating movement is produced by use of a jack (24) installed between the structure (23) and the frame (2), which actuates the roof with a swinging movement. The angle members (17) are then fixed on the frame (2) instead of the framework (1).

Figure 11:
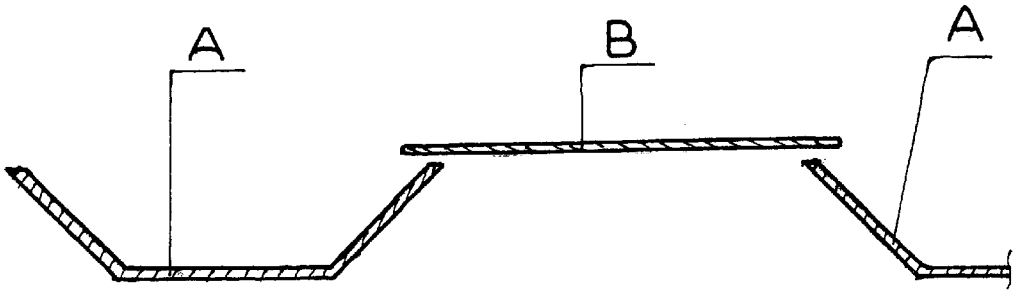
FIG. 11 shows a particular form of the slats.

FIG. 11 shows in cross section a particular shape of the slats (A) permitting rendering the roof sealed against rain. The slats (A) have their edges turned so as to serve as channels for evacuation of water. The slats (B) must be wider than the space which separates two slats (A). The slats being completely offset, the roof is then sealed against rain, the water being gathered by the slats (A). Gutters at the ends of the slats (A) evacuate the water.

The size of the device of the invention can be variable. The roof thus produced can as well be designed for one person or for several. The size and spacing of the slats (A) and (B) of the skylights can vary according to the material used for their production. These materials can be of any type, opaque or translucent, these latter letting pass the light whilst filtering out the ultraviolet rays. The narrower are the slats (A) and (B), the more reduced can be the reciprocating movement of their corresponding skylights, and the better will be the sensation of exposure to sunlight below the roof. It is also possible to create devices which only distribute the sunlight at a non-adjustable level by not providing skylights with slats (B). Similarly, it is possible to create according to the principle of the invention a device permitting adjusting the level of exposure to sunlight by means of skylights with slats (A) and (B), but without distributing it with the help of reciprocating movement.

The device of the invention is more particularly adapted for persons desiring to expose themselves in a reasonable manner to the sun as for example aged persons or infants. It finds its major application in the tourist industry and the leisure industry, above all in regions of high sunshine, as well as in the field of individual lodging.

What is claimed is:

1. A roof device for creating a surface with an adjustable level of exposure to sunlight, and for uniformly distributing sunlight, the roof device comprising:

an assembly comprised of (a) a first skylight comprising a plurality of spaced first slats; and (b) at least one second skylight comprising a plurality of spaced second slats; said second skylight being structured and arranged for sliding relative to said first skylight to move said second slats relative to said first slats and provide an adjustable offset between the first slats and the second slats; and means for reciprocating said assembly.

2. The roof device according to claim 1, wherein the first skylight is fixed on a frame, the second skylight is fixed on a chassis, and the frame and chassis rest on a framework.

3. The roof device according to claim 2, wherein the means for reciprocating the assembly comprise a motor reducer secured to the framework, a pinion, and a rack secured to the frame.

4. The roof device according to claim 2, further comprising rollers fixed on the frame for rolling the frame in the framework.

5. The roof device according to claim 2, further comprising rollers fixed on the framework which roll on a lower internal lateral surface of the framework, and thereby permit the roof device to be inclined.

6. The roof device according to claim 2, further comprising angle members fixed on the framework for preventing the frame and chassis from leaving the framework.

7. The roof device according to claim 2, further comprising a screw-threaded rod which passes through a tapped member fixed on a first cross member secured to the frame; said screw-threaded rod having an end which drives a corner piece fixed on a second cross member secured to the chassis for adjusting the chassis relative to the frame.

8. The roof device according to claim 2, further comprising rollers fixed on the chassis and rollaways fixed on the frame, for rolling the chassis in the frame.

9. The roof device according to claim 1, wherein the first skylight is fixed on a frame, the second skylight is fixed on a chassis; said roof device further comprising connecting members connecting the frame to a structure, a jack connecting the frame to the structure, thereby permitting the assembly to be driven with a reciprocating swinging movement.

10. The roof device according to claim 1, wherein the first slats of the first skylight have edges turned to form channels for evacuation of water, the second slats being structured and arranged to completely close the spaces between the first slats in order to seal the roof device against rain.

* * * * *